US008690144B2

(12) United States Patent
Kato et al.

(10) Patent No.: US 8,690,144 B2
(45) Date of Patent: Apr. 8, 2014

(54) SHEET PROCESSING APPARATUS THAT DETECTS STAPLES AND IMAGE FORMING APPARATUS

(75) Inventors: Hitoshi Kato, Toride (JP); Naoki Ishikawa, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/534,024

(22) Filed: Jun. 27, 2012

(65) Prior Publication Data

US 2013/0001847 A1 Jan. 3, 2013

(30) Foreign Application Priority Data

Jun. 28, 2011 (JP) ..... 2011-142802
Jun. 12, 2012 (JP) ..... 2012-132862

(51) Int. Cl.
*B65H 37/04* (2006.01)

(52) U.S. Cl.
USPC ..... 270/58.09; 270/58.08

(58) Field of Classification Search
USPC ..... 270/37, 52.18, 58.08, 58.09; 399/407, 399/408, 410
See application file for complete search history.

(56) References Cited

U.S. PATENT DOCUMENTS 7,448,615 B2 * 11/2008 Takamura ..... 271/176
2011/0079949 A1 * 4/2011 Taki et al. ..... 270/58.08

FOREIGN PATENT DOCUMENTS

JP 2005-263441 A 9/2005

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus which makes it possible to detect staples at a plurality of points by a smaller number of sensors. The sheet processing apparatus shifts a stapler along an edge of a sheet bundle. The stapler has a staple detection sensor attached thereto. The staple detection sensor detects a staple driven into the sheet bundle while passing by a staple detection position during shifting of the stapler. The stapler sequentially performs stapling at a first position and a second position along the edge of the sheet bundle, and is then shifted to a standby position. During a time period from completion of the stapling at the first position to completion of the shifting of the stapler to the standby position, the staple detection sensor detects presence or absence of a staple at each of the first position and the second position.

8 Claims, 13 Drawing Sheets

SHEET PROCESSING APPARATUS THAT DETECTS STAPLES AND IMAGE FORMING APPARATUS

BACKGROUND OF THE INVENTION

1. Field of the Invention

The present invention relates to a sheet processing apparatus for performing post-processing, such as stapling processing performed by a stapler, on sheets processed e.g. by an image forming apparatus, and the image forming apparatus including the sheet processing apparatus.

2. Description of the Related Art

There has been known a sheet processing apparatus connected to an image forming apparatus to perform post-processing, such as stapling processing (binding processing) performed by a stapler, on sheets conveyed from the image forming apparatus. More specifically, in the sheet processing apparatus, a sheet bundle is formed on an intermediate tray, and a stapler staples the trailing end of the sheet bundle using metal staples, whereby the sheet bundle is bound. After having been bound, the sheet bundle is conveyed along a conveying path provided on the intermediate tray, and is then discharged onto a discharge tray for sorting. In this case, a staple detection sensor is provided on the conveying path so as to detect the presence or absence of the staples during conveyance of the sheet bundle, whereby it is determined whether or not the sheet bundle has been normally bound. If the sheet bundle has not been normally bound, stapling processing is performed again on the sheet bundle using a saddle-stitching stapler provided downstream of the conveying path, and then the sheet bundle is discharged onto the sorting discharge tray in a positively bound state (see Japanese Patent Laid-Open Publication No. 2005-263441).

However, to detect staples used for binding processing at a plurality of points on a sheet bundle are detected on the conveying path, it is required to provide staple detection sensors corresponding in number to the staple points, which causes an increase in manufacturing costs of the apparatus. Further, to detect the staples by a smaller number of sensors, it is required to employ a method of performing detection while shifting the sensors, for example. With such a configuration, it is required to newly provide a drive mechanism for shifting the sensors, which also causes an increase in manufacturing costs of the apparatus.

SUMMARY OF THE INVENTION

The present invention provides a sheet processing apparatus which makes it possible to realize a mechanism for detecting staples at a plurality of points by a small number of sensors, at low costs, and an image forming apparatus including the sheet processing apparatus.

In a first aspect of the present invention, there is provided a sheet processing apparatus comprising a stapling unit configured to staple a sheet bundle with a staple, a shift unit configured to shift the stapling unit along an edge of the sheet bundle, a detection unit configured to detect the staple driven into the sheet bundle by the stapling unit, the detection unit being provided on the stapling unit and being shifted together with the stapling unit by the shift unit, and a controller configured to cause the stapling unit to sequentially perform stapling at a first position and a second position along the edge of the sheet bundle, and then control the stapling unit and the shift unit such that the stapling unit is shifted to a standby position, wherein during a time period from completion of the stapling at the first position to completion of the shifting of the stapling unit to the standby position, the detection unit detects presence or absence of a staple at each of the first position and the second position in accordance with the shifting of the stapling unit.

In a second aspect of the present invention, there is provided an image forming apparatus comprising an image forming unit configured to form an image on a sheet, a stapling unit configured to perform stapling processing using a staple on a sheet bundle formed by bundling a plurality of sheets each having an image formed thereon by the image forming unit, a shift unit configured to shift the stapling unit along an edge of the sheet bundle, a detection unit configured to detect the staple driven into the sheet bundle by the stapling unit, the detection unit being provided on the stapling unit and being shifted together with the stapling unit by the shift unit, and a controller configured to cause the stapling unit to sequentially perform stapling at a first position and a second position along the edge of the sheet bundle, and then control the stapling unit and the shift unit such that the stapling unit is shifted to a standby position, wherein during a time period from completion of the stapling at the first position to completion of the shifting of the stapling unit to the standby position, the detection unit detects presence or absence of a staple at each of the first position and the second position in accordance with the shifting of the stapling unit.

According to the present invention, the stapler is provided with the staple detection sensor, so that it possible to sequentially detect staples while shifting the stapler, i.e. to detect staples at a plurality of points by the single stapler. Further, since the sensor can be shifted using the existing stapler shift unit, it is not required to additionally provide a shift unit. Therefore, the present invention makes it possible to achieve low manufacturing costs of the apparatus.

Further features of the present invention will become apparent from the following description of an exemplary embodiment with reference to the attached drawings.

DESCRIPTION OF THE EMBODIMENTS

The present invention will now be described in detail below with reference to the accompanying drawings showing an embodiment thereof.

Figure 1:
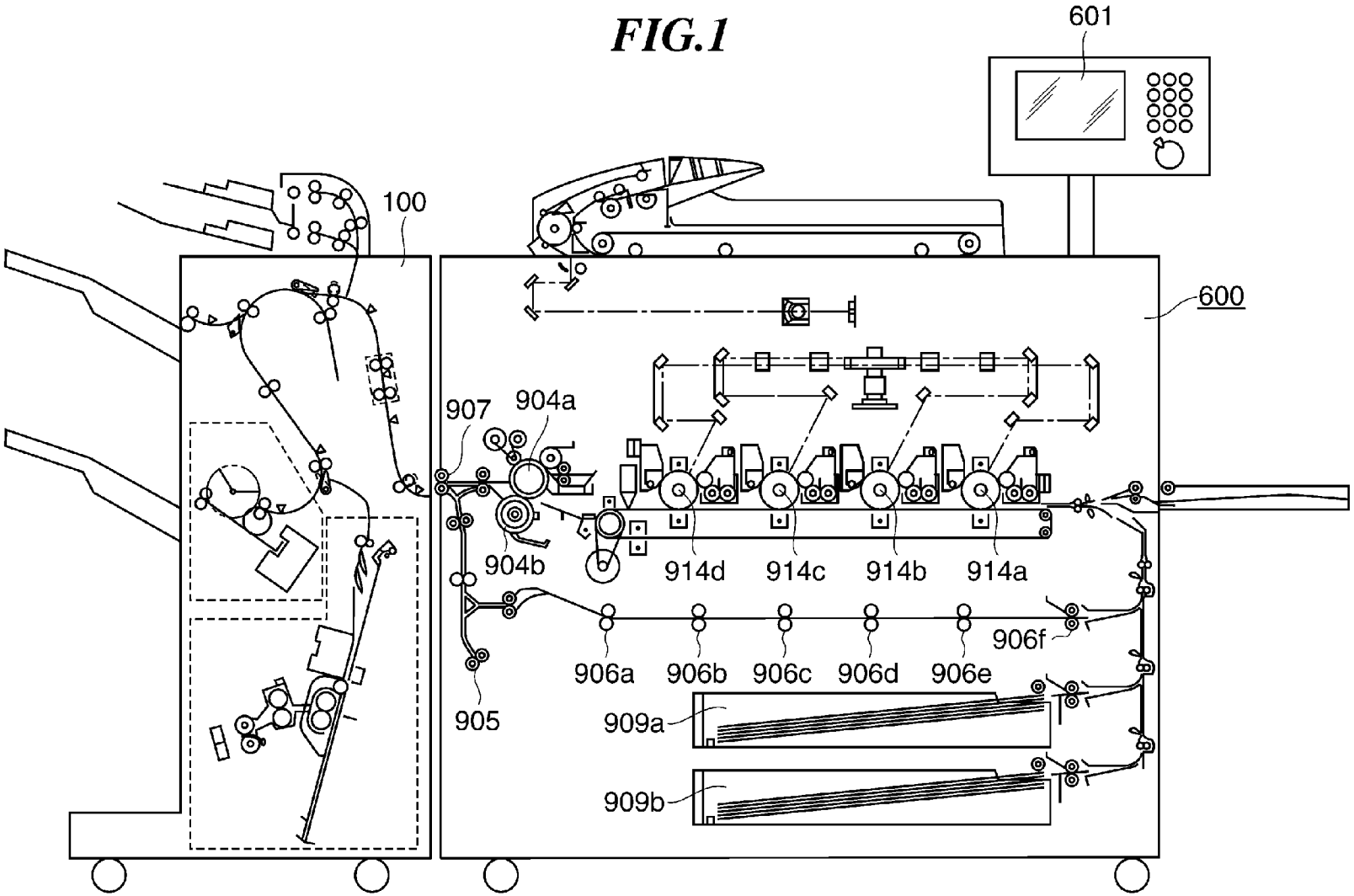
FIG. 1 is a schematic cross-sectional view of an image forming apparatus including a sheet processing apparatus according to an embodiment of the present invention.

FIG. 1 is a schematic cross-sectional view of an image forming apparatus including a sheet processing apparatus according to the embodiment of the present invention. The image forming apparatus comprises a main unit 600 for forming a monochrome or color image on a sheet, and the sheet processing apparatus 100 which is disposed adjacent to one side of the main unit 600 formed with a sheet discharge port and is connected online to the main unit 600. Sheets discharged from the main unit 600 are processed by the sheet processing apparatus 100. The image forming apparatus includes a console section 601, described hereinafter.

Note that the main unit 600 can also be singly used in a state where the sheet processing apparatus 100 is not connected thereto. The sheet processing apparatus 100 may be incorporated in the main unit 600, as a sheet discharge device.

In the following description, a side of the image forming apparatus toward a user facing the console section 601 (i.e. a front side as viewed in FIG. 1, in other words, a front side as viewed from the front of the apparatus) will be referred to as "front-view front side", and a back side of the image forming apparatus opposite to the front-view front side (i.e. a rear side as viewed in FIG. 1, in other words, a rear side as viewed from the front of the apparatus) will be referred to as "front-view depth-side".

In the image forming apparatus, in the case of forming a color image, four color-toner images are transferred onto a sheet fed from one of cassettes 909*a* and 909*b* of the main unit 600, by yellow, magenta, cyan, and black photosensitive drums 914*a*, 914*b*, 914*c*, and 914*d*, respectively. Thereafter, the sheet is conveyed to a fixing device, where the resulting toner image is fixed on the sheet by a pressure roller 904*a* and a fixing roller 904*b*.

In the case of forming an image on only one side of a sheet, after having undergone fixing processing, the sheet is discharged from the main unit 600 via a discharge roller pair 907 and is conveyed into the sheet processing unit 100. On the other hand, in the case of forming an image on the reverse side of the sheet as well, the sheet is passed to an inversion roller 905 from the fixing device, and when the trailing end of the sheet in the conveying direction passes an inversion flapper, the inversion roller 905 is reversely rotated, whereby the sheet is conveyed into a conveying path provided with double-sided-printing conveying rollers 906*a* to 906*f*. Then, four color-toner images are transferred again onto the reverse side of the sheet by the photosensitive drums 914*a* to 914*d*, respectively, and the resulting toner image is fixed on the sheet by the fixing device. Thereafter, the sheet is discharged from the main unit 600 via the discharge roller pair 907 and is conveyed into the sheet processing unit 100.

Figure 2:
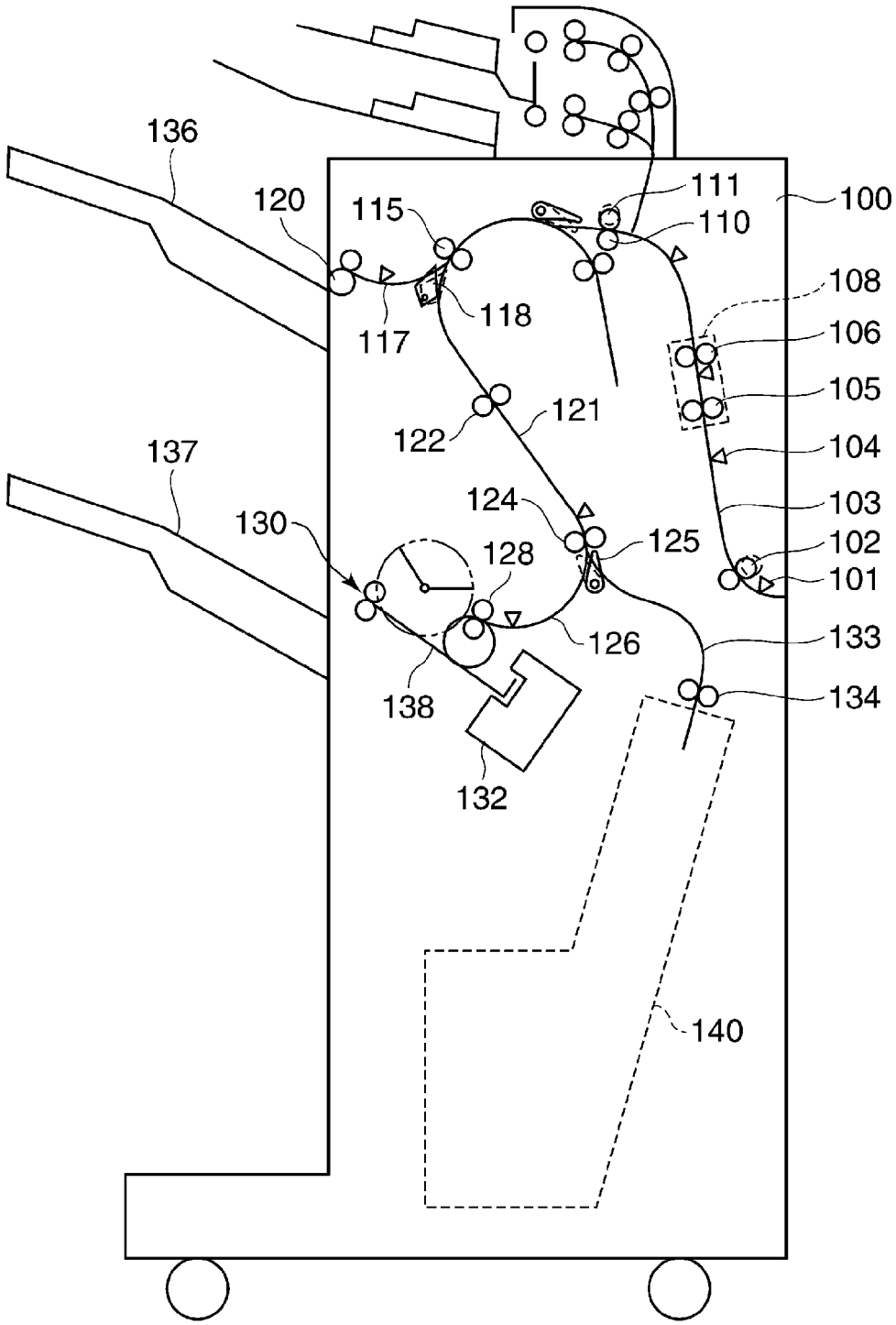
FIG. 2 is a cross-sectional view of the sheet processing apparatus appearing in FIG. 1.

FIG. 2 is a cross-sectional view of the sheet processing apparatus 100. The sheet discharged from the main unit 600 is passed to an inlet roller pair 102 of the sheet processing apparatus 100. At this time, sheet receiving timing is detected by an inlet sensor 101. The sheet conveyed by the inlet roller pair 102 passes through a conveying path 103. At this time, an edge position (leading edge) of the sheet is detected by a lateral registration detection sensor 104, whereby lateral registration deviation with respect to the center position (center) of the conveying path 103 is detected.

After the lateral registration deviation is detected, a shift unit 108 shifts toward the depth (in a direction perpendicular to a sheet surface of FIG. 2) by a predetermined amount during conveyance of the sheet by shift roller pairs 105 and 106, whereby a sheet shift operation (lateral registration correction) is executed. Thereafter, the sheet is conveyed by a conveying roller 110 and a separation roller 111, and is further conveyed by a buffer roller pair 115.

When sheets are to be discharged onto an upper tray 136, an upper path-switching flapper 118 is brought into a state depicted in broken lines in FIG. 2 by a drive unit, such as a solenoid, not shown, whereby each of the sheets is guided into an upper conveying path 117, and is then discharged onto the upper tray 136 by an upper discharge roller 120. On the other hand, when sheets are not to be discharged onto the upper tray 136, the sheets conveyed by the buffer roller pair 115 are guided into a bundle conveying path 121 by the upper path-switching flapper 118, and are passed therethrough sequentially by a buffer roller pair 122 and a bundle conveying roller pair 124.

When sheets are to be subjected to saddle-stitching processing, a saddle path-switching flapper 125 is brought into a state depicted in broken lines in FIG. 2 by a drive unit, such as a solenoid, not shown, whereby the sheets are guided into a saddle path 133. Then, the sheets are guided into a saddle unit 140 by a saddle inlet roller pair 134, and are saddle-stitched. Saddle-stitch processing is general processing, but is not an essential part of the present invention. Therefore, detailed description thereof is omitted.

When sheets are to be discharged onto a lower tray 137, the sheets conveyed by the bundle conveying roller pair 124 are guided into a lower path 126 by the saddle path-switching flapper 125. Then, the sheets are discharged onto a processing tray 138 by a lower discharge roller pair 128, whereafter the sheets are subjected to processing in the processing tray 138, and are then discharged onto the lower tray 137 by a bundle discharge roller pair 130. The sheet processing on sheets in the processing tray 138 will be described in detail hereinafter.

Figure 3:
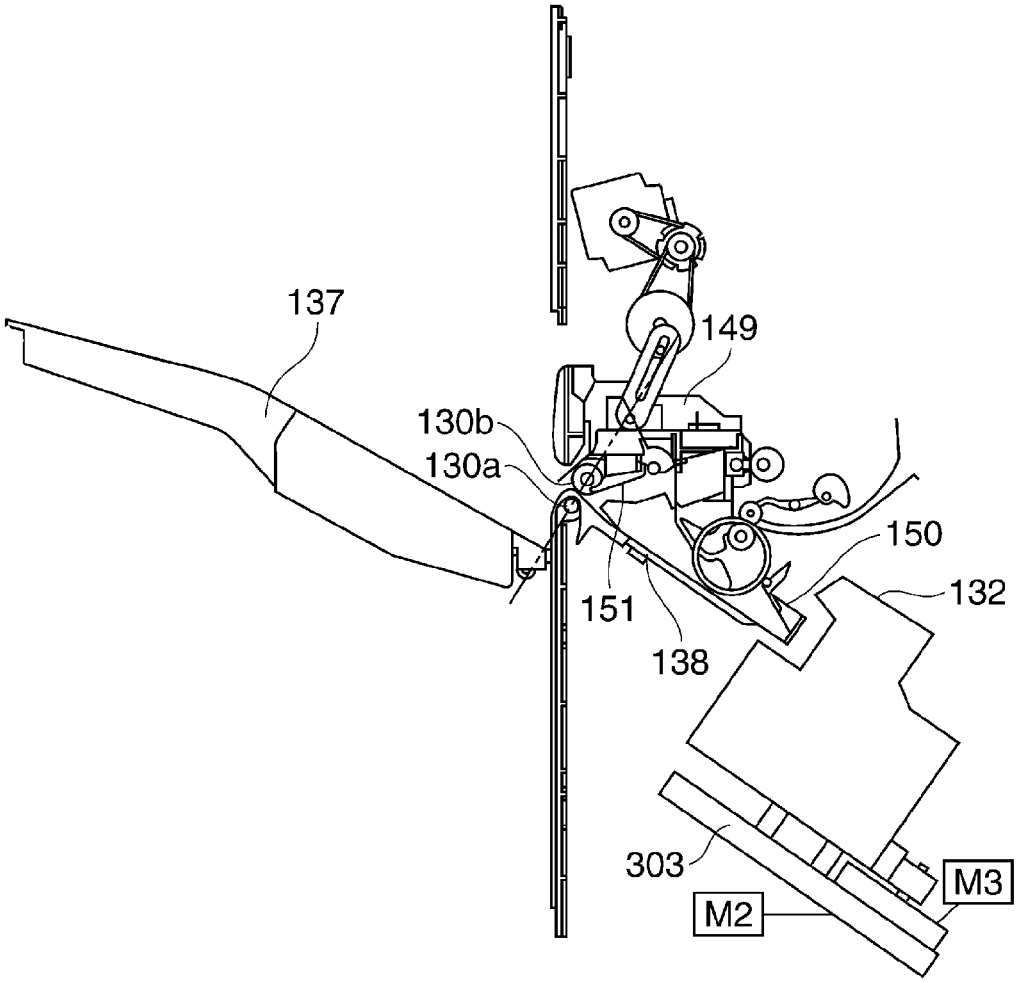
FIG. 3 is a cross-sectional view of a processing tray and component parts therearound of the sheet processing apparatus in FIG. 2.

Next, a description will be given, with reference to FIGS. 3 to 5B, of the processing tray 138 and component parts therearound. FIG. 3 is a cross-sectional view of the processing tray 138 and the component parts therearound. The processing tray 138 is disposed tilted such that the downstream side (left side as viewed in FIG. 3) thereof is positioned upward in a sheet bundle discharging direction and the upstream side (right side as viewed in FIG. 3) thereof is positioned downward.

The lower end of the processing tray 138 as the upstream side thereof has a rear end stopper 150 formed therewith. The upper end of the processing tray 138 as the downstream side thereof is provided with a lower discharge roller 130*a* as one roller of the bundle discharge roller pair 130, and an upper discharge roller 130*b* as the other roller of the bundle discharge roller pair 130 is disposed on the lower-surface front end of a swinging guide 149.

The upper discharge roller 130*b* is brought into or out of contact with the lower discharge roller 130*a* in accordance with the closing and opening operation of the swinging guide 149. The bundle discharge roller pair 130 (lower discharge roller 130*a* and upper discharge roller 130*b*) can be rotated normally and reversely by a drive motor, not shown. The swinging guide 149 is provided with a guide 151 located upstream of the upper discharge roller 130*b* and configured to guide a sheet to a roller nip of the upper discharge roller 130*b*.

A stapler 132 for stapling a sheet bundle by staples has its home position set to the lower end, which is on the upstream side, of the processing tray 138. The stapler 132 including a staple motor M1 (see FIG. 9) is driven by the staple motor M1 to drive metal staples into a sheet bundle, thereby binding the sheet bundle. In the stapler 132, there is provided a cartridge containing staples, and the presence or absence of staples within the cartridge is detected by a staple remaining amount detection sensor 408 (see FIG. 9).

The stapler 132 is shifted by driving a stapler shift motor M2 to thereby cause a slide support base 303 supporting the stapler 132 to be shifted along an edge of a sheet bundle.

Figure 4:
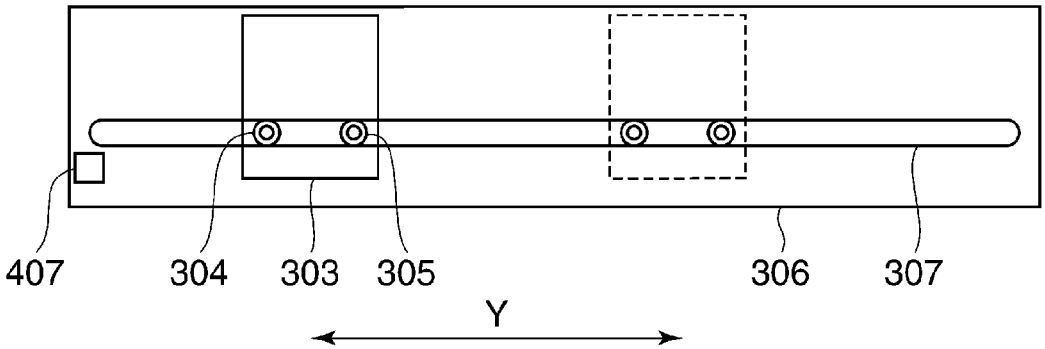
FIG. 4 is a top view of slide operation-related parts of a stapler of the sheet processing apparatus in FIG. 2.

FIG. 4 is a top view of slide operation-related parts of the stapler 132. The slide support base 303 (see FIG. 3) supporting the stapler 132 has a bottom thereof provided with rolling rollers 304 and 305. The slide support base 303 can be shifted along the trailing edge of sheets in a direction indicated by an arrow Y (perpendicular to a sheet surface on which FIG. 3 is depicted, in FIG. 3) while being guided by the rolling rollers 304 and 305 and a guide rail groove 307 formed in a stapler shift base 306.

On the stapler shift base 306, there is provided a stapler shift HP sensor 407 for detecting the home position of the stapler 132. Note that the stapler 132 is usually kept on standby at its home position in the front of the apparatus.

Figure 5A:
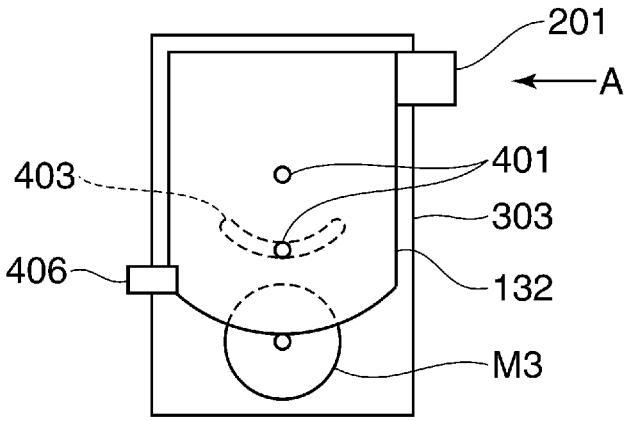
FIGS. 5A and 5B are top views of stapler rotational operation-related portions of the stapler of the sheet processing apparatus in FIG. 2.
Figure 5B:
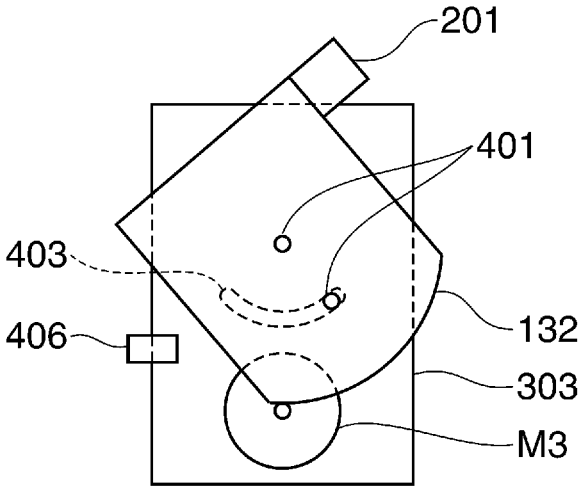

FIGS. 5A and 5B are top views of rotational operation-related portions of the stapler 132. As shown in FIG. 5A, the stapler 132 is fixed to the slide support base 303 by two pins 401, and one of the pins 401 is fitted in an arcuate slot 403 formed in the stapler 132. The stapler 132 has a gear section formed concentrically with the arcuate slot 403. As shown in FIG. 5B, the angle of the stapler 132 can be changed by rotating the gear section by a stapler rotation motor M3.

On the slide support base 303, there is provided a stapler rotation HP sensor 406 for detecting a home position of the stapler 132 in the rotational direction. The rotational angle of the stapler 132 can be determined based on the amount of rotation of the stapler rotation motor M3 with reference to a detection position of the stapler rotation HP sensor 406.

The stapler 132 is provided with a staple detection sensor 201 for detecting the presence or absence of a staple in a sheet bundle (i.e. whether or not a staple has been normally driven into the sheet bundle). The staple detection sensor 201 is disposed on the front-view depth-side of the stapler 132, which is the rear side of the stapler 132 in an advancing direction of stapling operation. The staple detection sensor 201 is caused to pass over or under a stapling position on a sheet bundle during the shifting of the stapler 132 for a stapling operation, whereby it is possible to check whether or not the sheet bundle has been bound by staples. A method of detecting staples by the staple detection sensor 201 will be described hereinafter. Note that the "advancing direction" of the stapler 132 corresponds to a direction in which the stapler 132 shifts from a first stapling position to a staple detection end position via a second stapling position, all of which will be referred to hereinafter, in a stapling control process, described hereinafter with reference to FIG. 11. The "advancing direction" is opposite to a "retreat direction" defined as corresponding to a direction in which the stapler 132 returns from the staple detection end position to the standby position via the second stapling position and the first stapling position so as to be ready for stapling of a next sheet bundle.

Figure 6A:
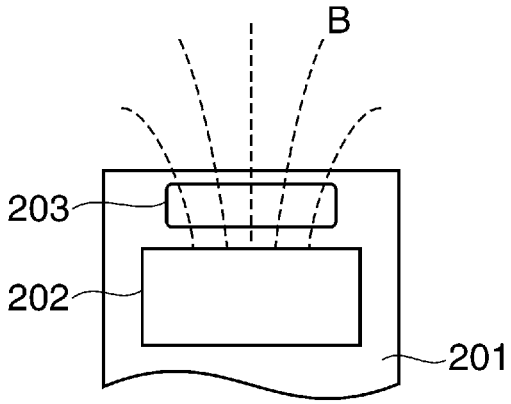
FIGS. 6A to 6C are views of a staple detection sensor attached to the stapler in FIG. 3, as viewed in a direction indicated by an arrow A appearing in FIG. 5A.
Figure 6B:
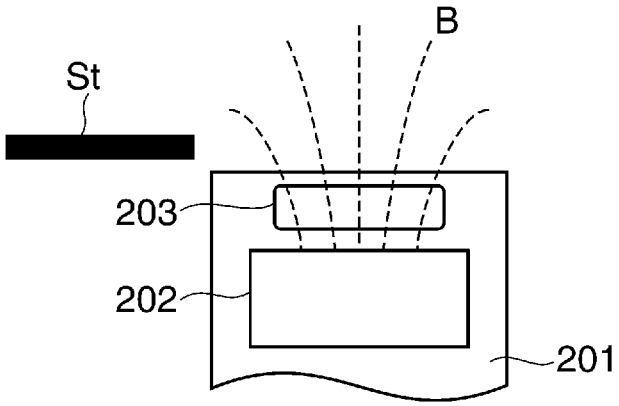
Figure 6C:
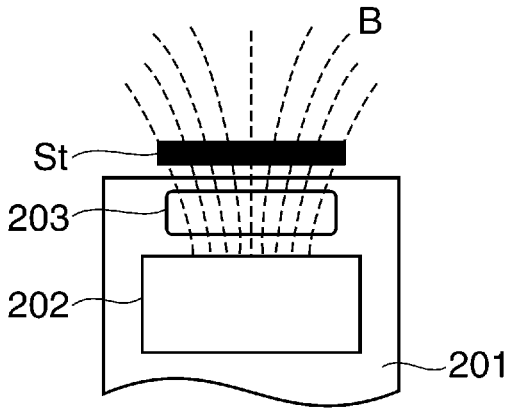

FIGS. 6A to 6C are views of the staple detection sensor 201 as viewed in a direction indicated by an arrow A appearing in FIG. 5A. FIG. 6A schematically shows the arrangement of the staple detection sensor 201. The staple detection sensor 201 comprises a combination of a permanent magnet 202 and a magnetoresistive element 203, and the magnetoresistive element 203 is configured to detect magnetic flux B generated from the permanent magnet 202.

The magnetoresistive element 203 has a characteristic that as the magnetic flux B passing through the magnetoresistive element 203 increases (i.e. as the magnetic flux density becomes higher), its magnetoresistive value becomes larger, and as the magnetic flux B passing through the magnetoresistive element 203 decreases (i.e. as the magnetic flux density becomes lower), its magnetoresistive value becomes smaller. When a staple which is a magnetic material passes the magnetoresistive element 203 along a detection surface thereof, the magnetic flux B passing through the magnetoresistive element 203 changes, whereby the magnetoresistive value is changed. By making use of this change, the staple detection sensor 201 converts the magnetoresistive value of the magnetoresistive element 203 to an electric signal, and then amplifies the electric signal by an amplification circuit 82, referred to hereinafter, to obtain an amplified output from the amplification circuit 82, to thereby detect the presence or absence of a staple.

FIGS. 6B and 6C are views schematically illustrating a case where the absence of a staple is detected and a case where the presence of a staple is detected, respectively. As shown in FIG. 6B, when a staple St is distant from the staple detection sensor 201, the magnetic flux B passing through the magnetoresistive element 203 is small, and the magnetoresistive value of the magnetoresistive element 203 is small. On the other hand, when the staple St is immediately above the staple detection sensor 201 as shown in FIG. 6C, the magnetic flux B passing through the magnetoresistive element 203 is large, and the magnetoresistive value of the magnetoresistive element 203 is large. Thus, the presence or absence of the staple St can be detected based on a difference in the magnetoresistive value caused by the presence or absence of the staple St.

Figure 7:
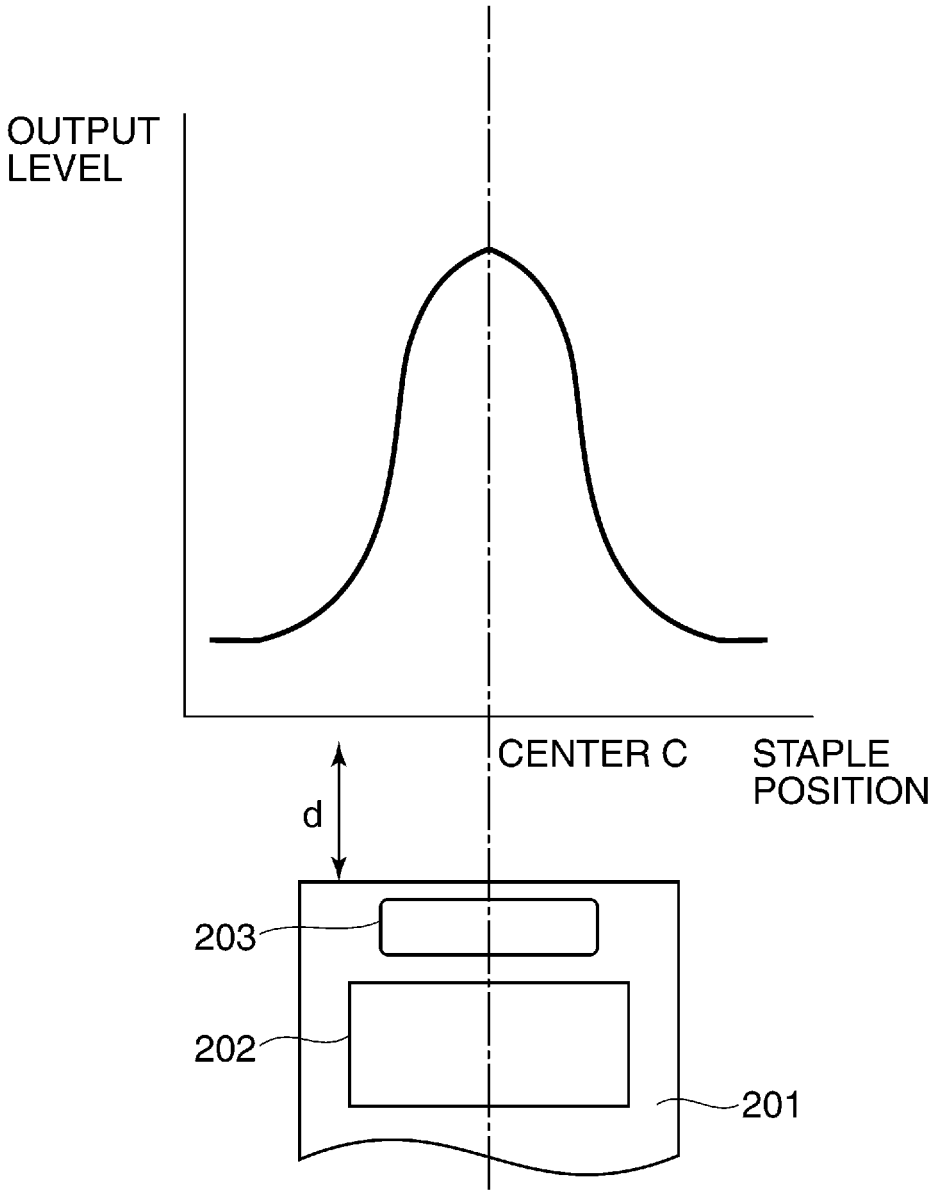
FIG. 7 is a diagram showing characteristics of an electric signal output from the staple detection sensor shown in FIGS. 6A to 6C, according to a staple position.

FIG. 7 is a diagram showing characteristics of the electric signal output from the staple detection sensor 201 according to the staple position. As the position of the staple St is closer to the center C of the staple detection sensor 201, the output level of the electric signal is higher. Note that distance enabling detection of the staple St by the staple detection sensor 201 falls within a range of a predetermined distance d from the detection surface of the staple detection sensor 201.

Figure 8A:
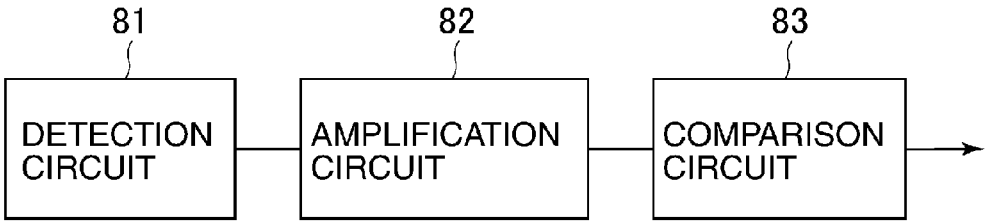
FIG. 8A is a block diagram showing a circuit configuration of the staple detection sensor in FIGS. 6A to 6C.
Figure 8B:
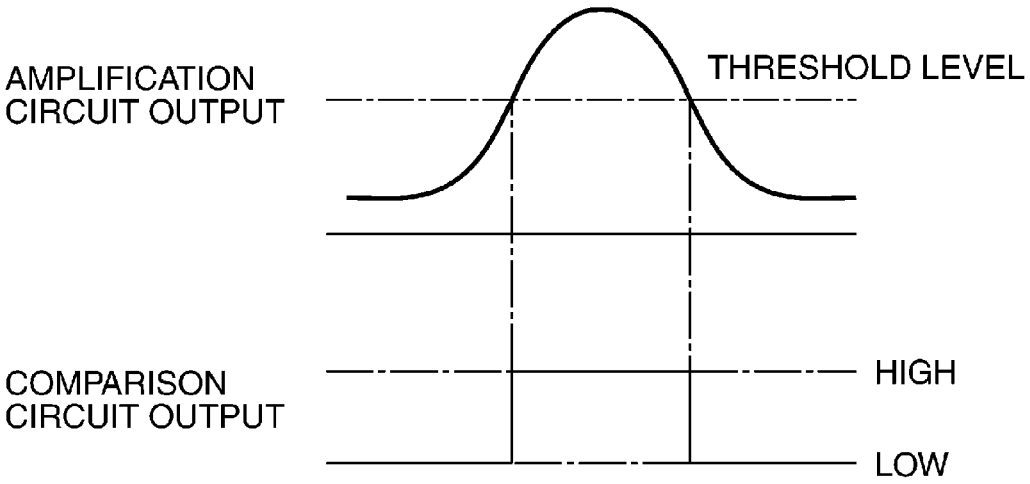
FIG. 8B is a diagram useful in explaining a method of determining the presence or absence of a staple St.

FIGS. 8A and 8B are a block diagram showing a circuit configuration of the staple detection sensor 201 in FIGS. 6A to 6C and a diagram useful in explaining a method of determining the presence or absence of a staple St, respectively. As shown in FIG. 8A, the staple detection sensor 201 comprises a detection circuit 81 for detecting the magnetoresistive value of the magnetoresistive element 203 and converting the magnetoresistive value to an electric signal, the amplification circuit 82 for amplifying the electric signal from the detection circuit 81, and a comparison circuit 83 for performing comparison concerning the electric signal output from the amplification circuit 82.

As shown in FIG. 8B, the comparison circuit 83 determines whether an amplification circuit output which is output as an analog value from the amplification circuit 82 is larger or smaller than a predetermined threshold level (threshold value). If the analog value of the amplification circuit output is larger than the threshold level, the comparison circuit 83 outputs a high-level signal indicating that a staple has been detected. On the other hand, if the analog value of the amplification circuit output is smaller than the threshold level, the comparison circuit 83 outputs a low-level signal indicating that no staple has been detected.

Although in the present embodiment, the staple detection sensor 201 is implemented by a magnetic sensor as described above, this is not limitative, but there may be employed a method of causing a electric current to flow through a staple, a method using an electrostatic capacity sensor, or a method in which a lever is brought into contact with a sheet surface to thereby detect asperities on the surface.

Figure 9:
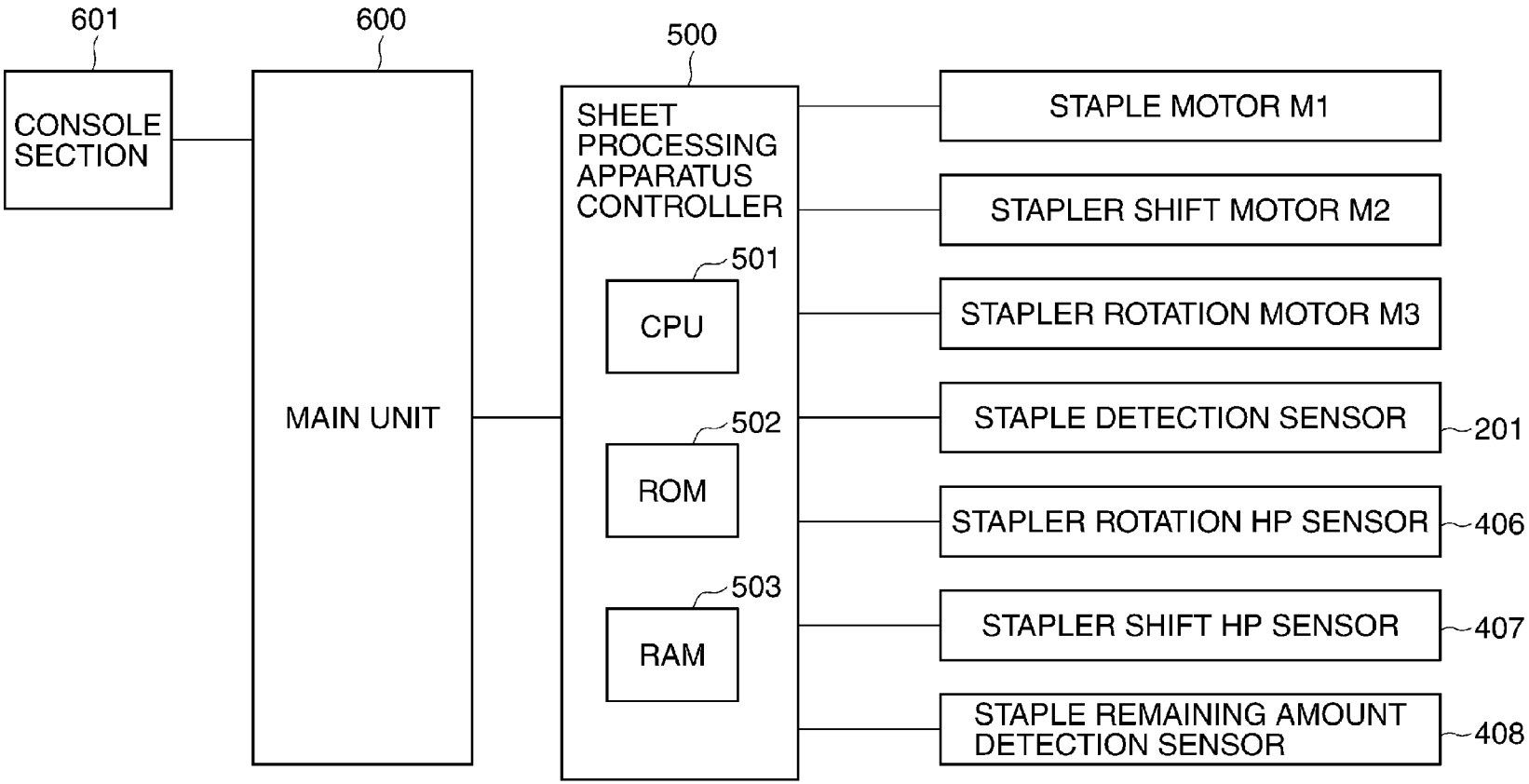
FIG. 9 is a control block diagram of the image forming apparatus in FIG. 1.

FIG. 9 is a control block diagram of the image forming apparatus. A sheet processing apparatus controller 500 is incorporated in the sheet processing apparatus 100, for example, and communicates with the main unit 600 for data exchange. The processing apparatus controller 500 includes a CPU 501, a ROM 502, and a RAM 503. The CPU 501 executes various programs stored in the ROM 502 by loading the programs into the RAM 503, to thereby perform centralized overall control of the operation of the sheet processing apparatus 100.

Connected to the main unit 600 is the console section 601 for setting image forming conditions of the main unit 600 and post-processing conditions of the sheet processing apparatus 100. Specifically, the console section 601 is provided with various buttons a display device for, for performing configuration of an operation mode (sheet size, monochrome or color printing, single-sided or double-sided printing, post-processing conditions e.g. for binding processing, etc.), jam warning, and so forth.

Connected to the sheet processing apparatus controller 500 are the staple motor M1, the stapler shift motor M2, and the stapler rotation motor M3. Further, the staple detection sensor 201, the stapler rotation HP sensor 406, the stapler shift HP sensor 407, and the staple remaining amount detection sensor 408 are connected to the sheet processing apparatus controller 500.

Figure 10A:
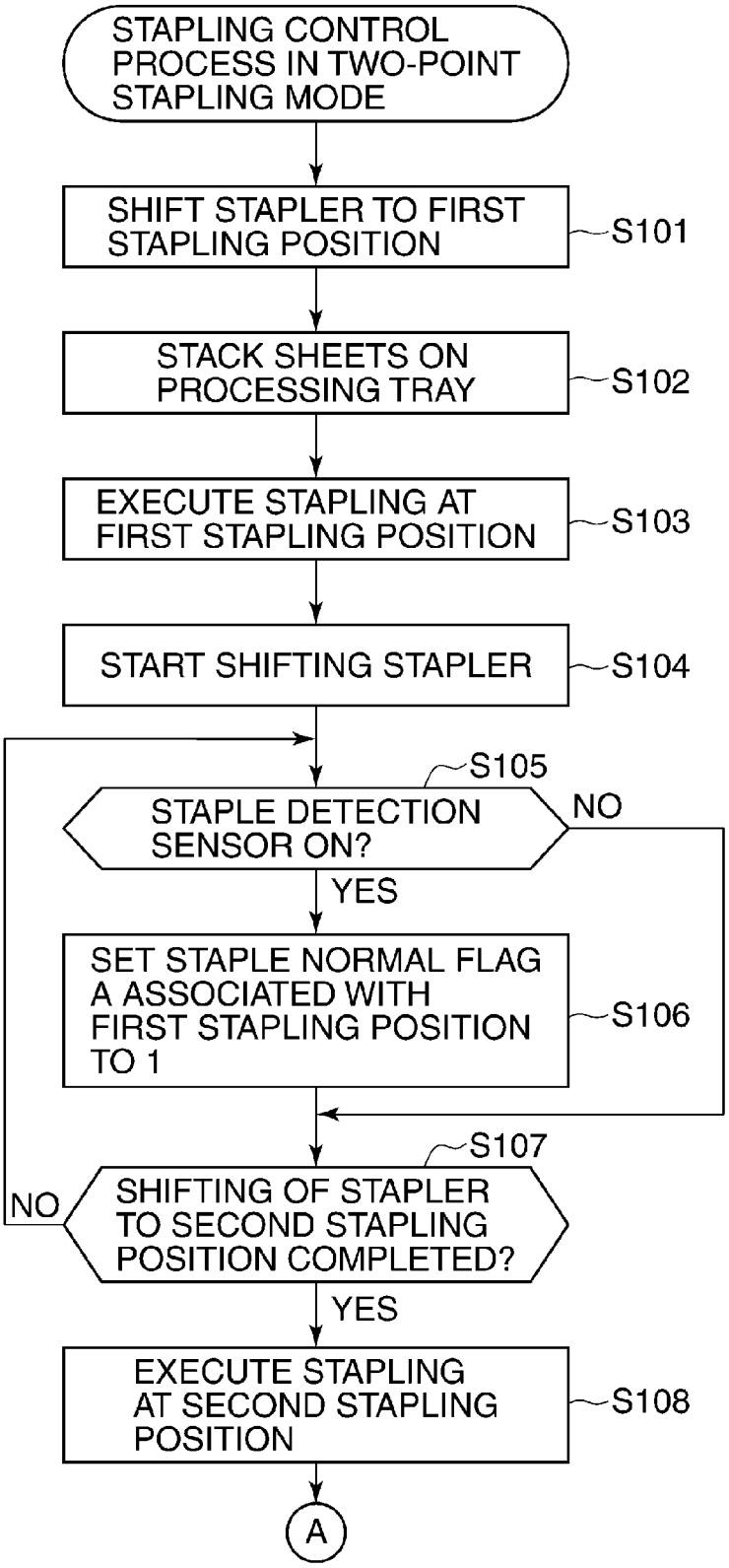
FIGS. 10A and 10B are a flowchart of a stapling control process in a two-point stapling mode executed by the sheet processing apparatus in FIG. 2.
Figure 10B:
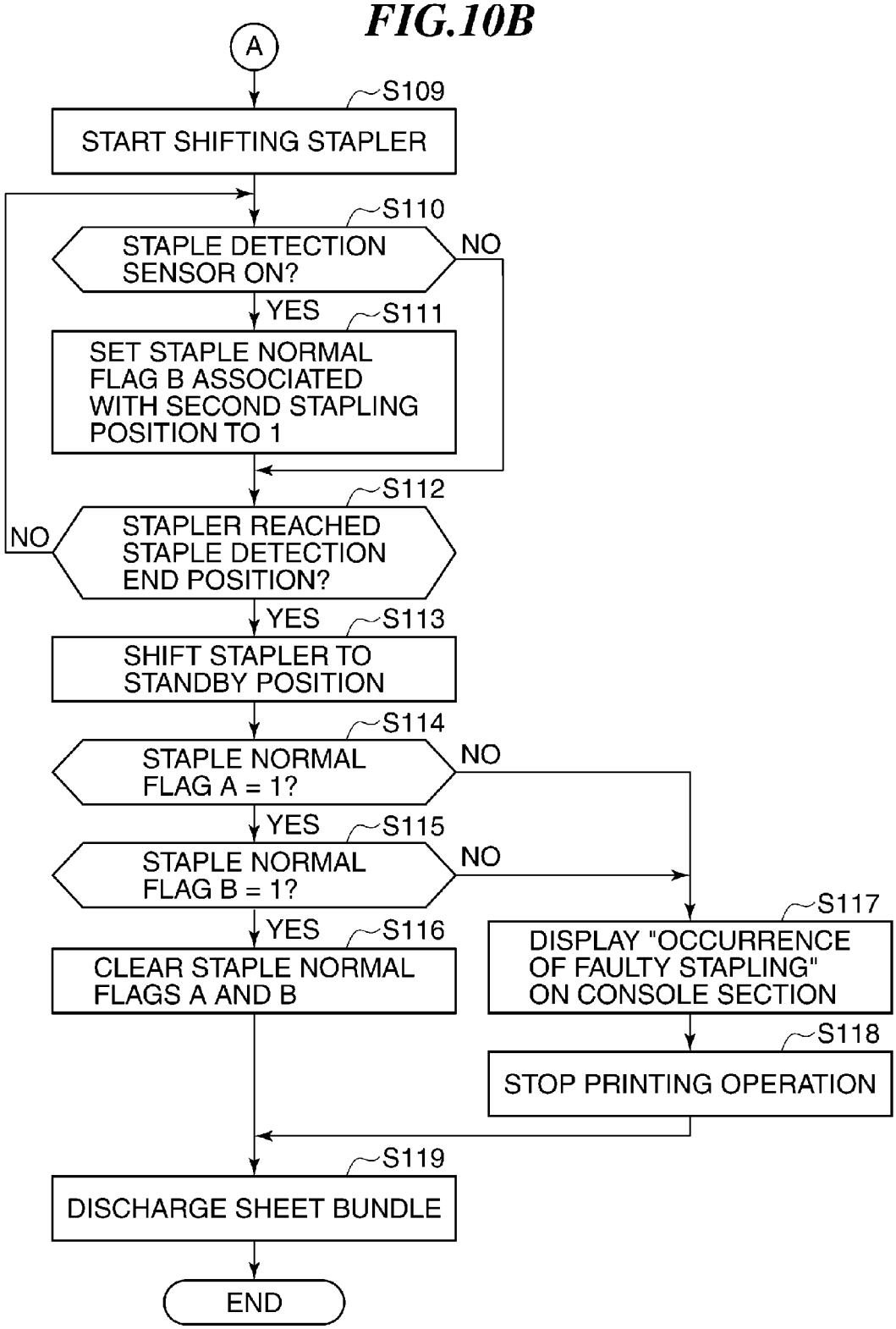

FIGS. 10A and 10B are a flowchart of a stapling control process in a two-point stapling mode executed by the sheet processing apparatus 102, and FIGS. 11A to 11D are views showing the positional relationship between the stapler 132 and a sheet bundle S in the two-point stapling mode. The two-point stapling mode is a mode for stapling a sheet bundle at two points in the trailing end of the sheet bundle. Note that control of various operations carried out in the stapling control process in FIGS. 10A and 10B is achieved by the CPU 501 by loading a program stored in the ROM 502 into the RAM 503 according to an instruction from the main unit 600.

Figure 11A:
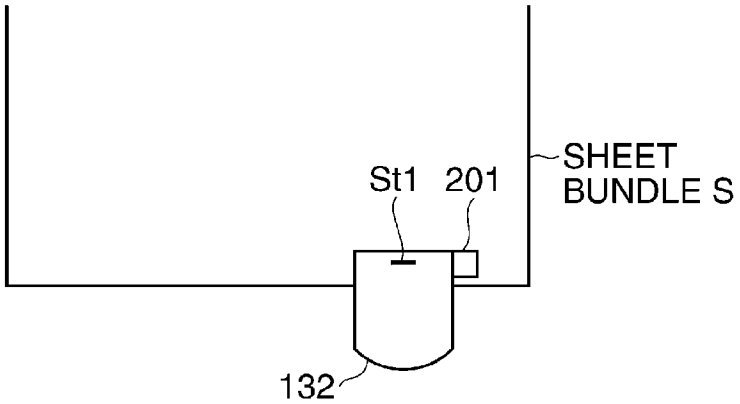
FIGS. 11A to 11D are views showing the positional relationship between the stapler and a sheet bundle in the two-point stapling mode of the sheet processing apparatus in FIG. 2.

First, the CPU 501 shifts the stapler 132 to a first stapling position, as shown in FIG. 11A (step S101), and causes sheets to stack on the processing tray 138 (step S102). When all sheets to form a sheet bundle have been stacked, the CPU 501 causes the stapler 132 to perform a stapling operation (binding processing) at the first stapling position (step S103). Then, the CPU 501 starts shifting the stapler 132 to a second stapling position (step S104).

Figure 11B:
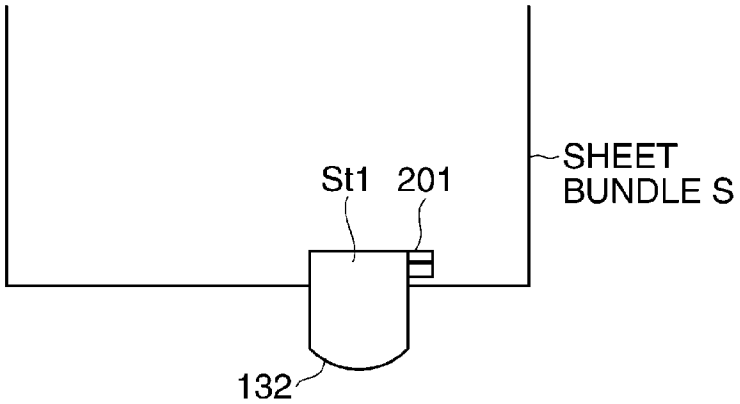

In the present embodiment, a stapling position which is a trailing-side one of the two stapling positions in the advancing direction of the stapler 132 is set as the first stapling position, and a stapling position which is a leading-side one of the two stapling positions in the advancing direction of the stapler 132 is set as the second stapling position. For this reason, as shown in FIG. 11B, the staple detection sensor 201 is positioned on a trailing side of the stapler 132 in the advancing direction in which the stapler 132 advances from the first stapling position to the second stapling position. This makes it possible to detect a staple St1 used for the stapling operation (binding processing) at the first stapling position, during the shifting of the stapler 132 from the first stapling position to the second stapling position. Referring again to FIGS. 10A and 10B, it is checked whether or not the staple detection sensor 201 has been turned on (step S105). The wording that "the staple detection sensor 201 has been turned on" means that the high-level signal explained with reference to FIG. 8B has been output.

If the staple detection sensor 201 has been turned on (YES to the step S105), the CPU 501 sets the bit of a staple normal flag A associated with the first stapling position to 1 (step S106). The result of the step S106 is temporality stored in the RAM 503. Thereafter, the CPU 501 checks whether or not the shifting of the stapler 132 to the second stapling position has been completed (step S107). If the staple detection sensor 201 remains off (NO to the step S105), the CPU 501 causes the process to directly proceed to the step S107.

Figure 11C:
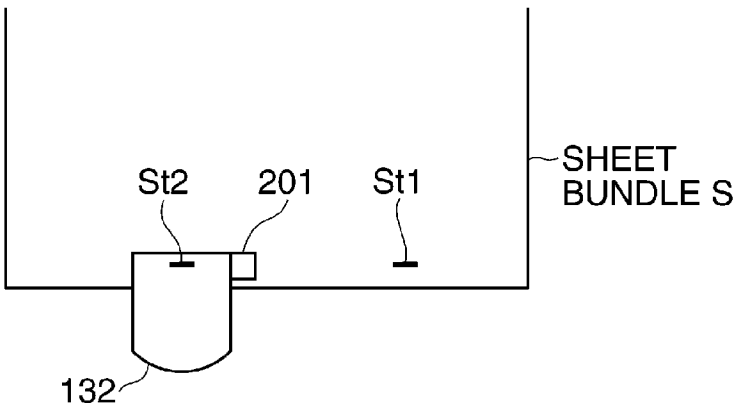

Before the shift of the stapler 132 to the second stapling position is completed (NO to the step S107), the CPU 501 repeatedly carries out the steps S105 to S107. When the shift of the stapler 132 to the second stapling position is completed (YES to the step S107), the CPU 501 causes the stapler 132 to perform a stapling operation at the second stapling position (step S108) as shown in FIG. 11C. After execution of the step S108, the CPU 501 starts moving the stapler 132 (step S109) so as to detect a staple St2 used for the stapling operation (binding processing) at the second stapling operation, and checks whether or not the staple detection sensor 201 has been turned on (step S110).

Figure 11D:
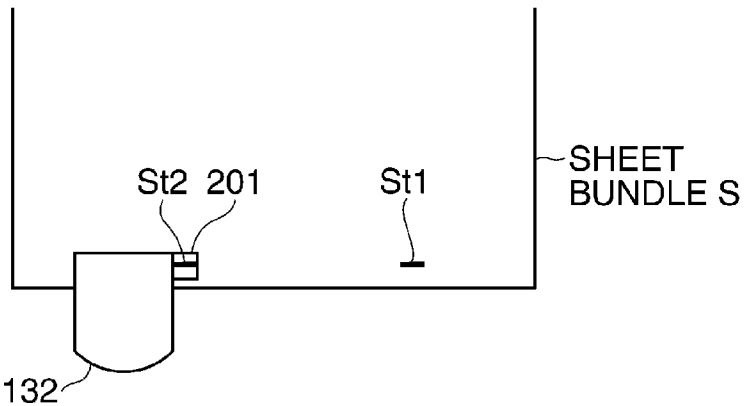

If the staple detection sensor 201 has been turned on (YES to the step S110), the CPU 501 sets the bit of a staple normal flag B associated with the second stapling position to 1 (step S111). The result of the step S111 is temporality stored in the RAM 503. Thereafter, the CPU 501 checks whether or not the shift of the stapler 132 to the staple detection end position has been completed (step S112). The staple detection end position corresponds to a position where the staple detection sensor 201 faces the staple St2 used for the stapling operation (binding processing) at the second stapling position, as shown in FIG. 11D. On the other hand, if the staple detection sensor 201 remains off (NO to the step S110), the CPU 501 causes the process to proceed to the step S112.

If the shift of the stapler 132 to the staple detection end position is not completed (NO to the step S112), the CPU 501 repeatedly carries out the steps S110 to S112. If the shift of the stapler 132 to the staple detection end position is completed (YES to the step S112, the CPU 501 starts to move the stapler 132 to the standby position (step S113). Thereafter, the CPU 501 checks whether or not the bit of the staple normal flag A is 1 (step S114). If the staple normal flag A is 1 (YES to the step S114), the CPU 501 causes the process to proceed to a step S115, whereas if the staple normal flag A is not 1 (NO to the step S114), the CPU 501 causes the process to proceed to a step S117.

In the step S115, the CPU 501 checks whether or not the bit of the staple normal flag B is 1. If the staple normal flag B is 1 (YES to the step S115), the CPU 501 causes the process to proceed to a step S116, whereas if the staple normal flag B is not set to (NO to the step S115), the CPU 501 causes the process to proceed to the step S117.

In the step S116, it is judged that the binding processing has been normally completed, and therefore the CPU 501 clears the staple normal flags A and B, and then causes the sheet bundle S to be discharged onto the lower tray 137 (step S119), followed by terminating the present process. On the other hand, in the step S117, it is judged that the stapling operation (binding processing) at the first stapling position or the second stapling position has not been normally performed, and therefore the CPU 501 determines that faulty stapling has occurred, and sends an error notification to the main unit 600 to cause the main unit 600 to display a message indicative of occurrence of the faulty stapling on the display device of the console section 601. In short, the CPU 501 functions as a determination unit. After execution of the step S117, the CPU 501 instructs the main unit 600 to stop an image forming operation (print operation) (step S118). As a consequence, the print operation of the main unit 600 is stopped. In short, the CPU 501 functions as a stoppage control unit. Thereafter, the process proceeds to a step S119, and the CPU 501 causes the sheet bundle S to be discharged onto the lower tray 137, followed by terminating the present process.

In the above-described stapling control process, even if no staple has been detected in the detection performed after execution of the stapling at the first stapling position (NO to the step S105), the stapler 132 is shifted to the second stapling position and performs stapling at the second stapling position. However, when the staple detection sensor 201 remains off (NO to the step S105), the CPU 501 may perform control such that the stapling operation at the second stapling position is skipped. In this case, the process immediately proceeds to the step S117, wherein the message indicative of faulty stapling is displayed.

As described above, according to the present embodiment, since the staple detection sensor 201 is attached to the stapler 132, it is possible to detect staples St at a plurality of points by the single staple detection sensor 201 by utilizing the shifting of the stapler 132 performed for binding processing. Further, since an existing shift unit for shifting the stapler 132 can also be used as a shift unit for shifting the single staple detection sensor 201, it is not required to additionally provide a shift unit, which makes it possible to detect a plurality of staples St by a low-cost mechanism.

Figure 12:
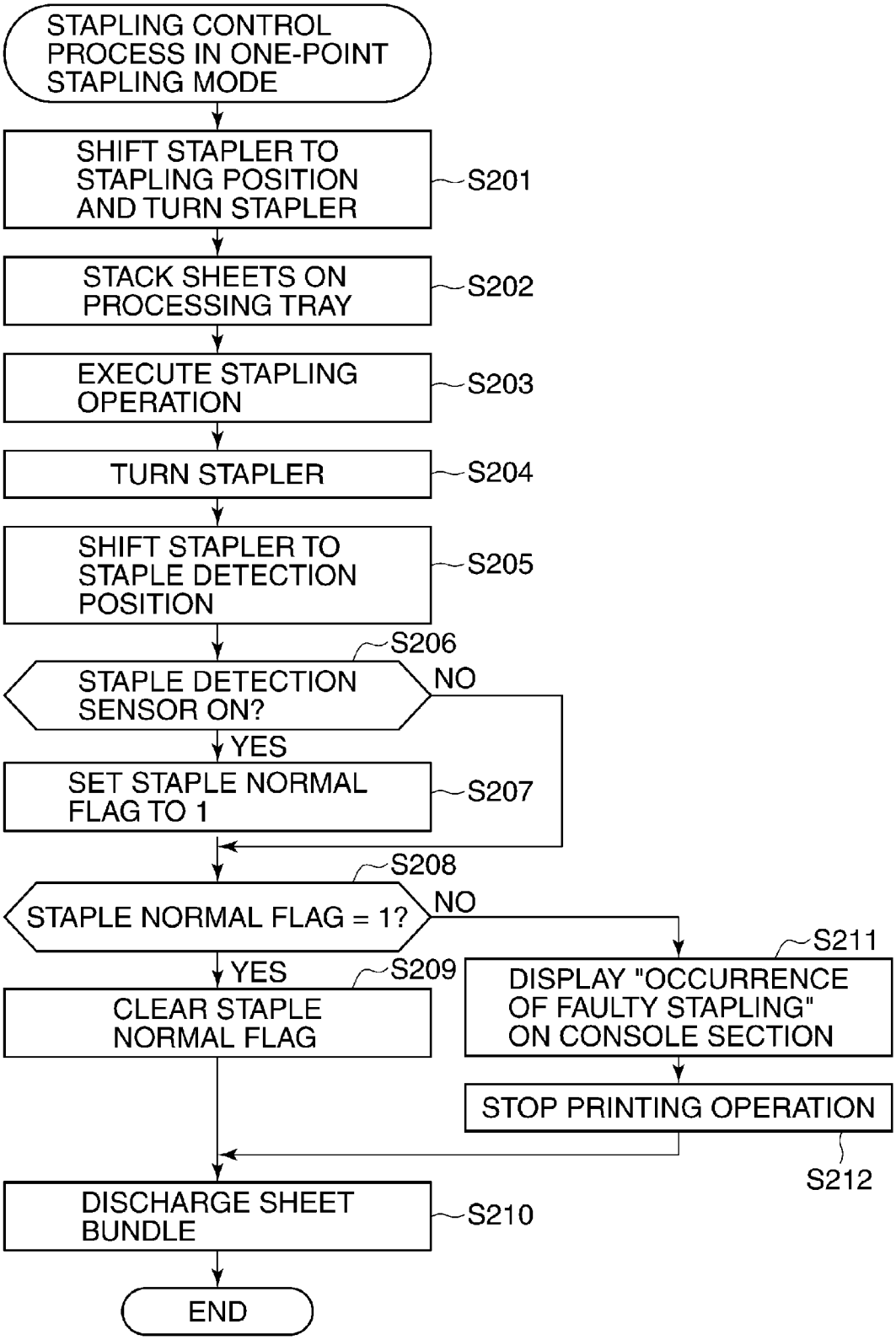
FIG. 12 is a flowchart of a stapling control process in a one-point stapling mode executed by the sheet processing apparatus in FIG. 2.
Figure 13A:
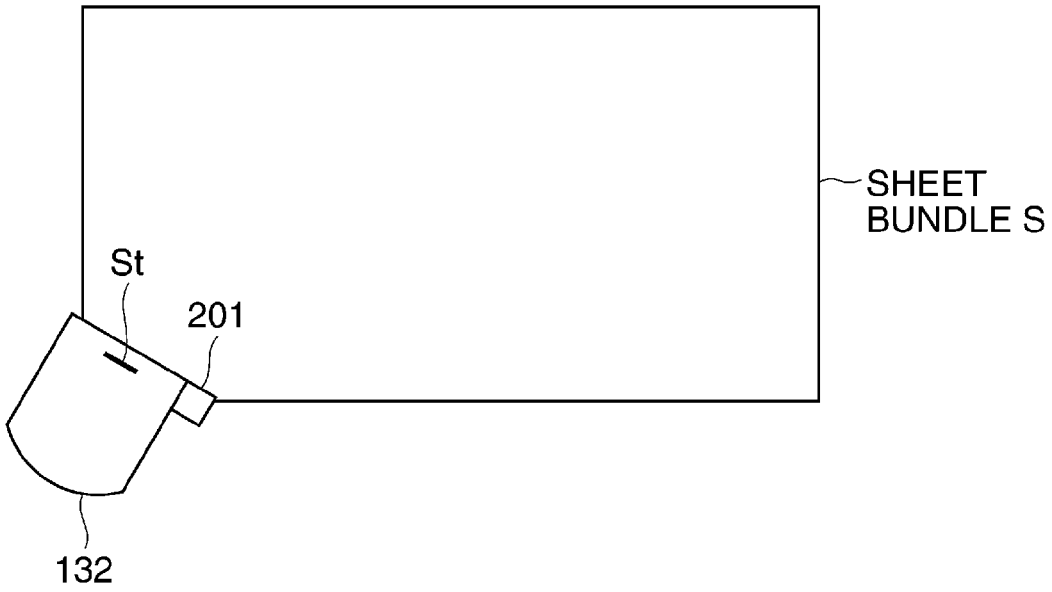
FIGS. 13A and 13B are views showing the positional relationship between the stapler and a sheet bundle in the one-point stapling mode of the sheet processing apparatus in FIG. 2.
Figure 13B:
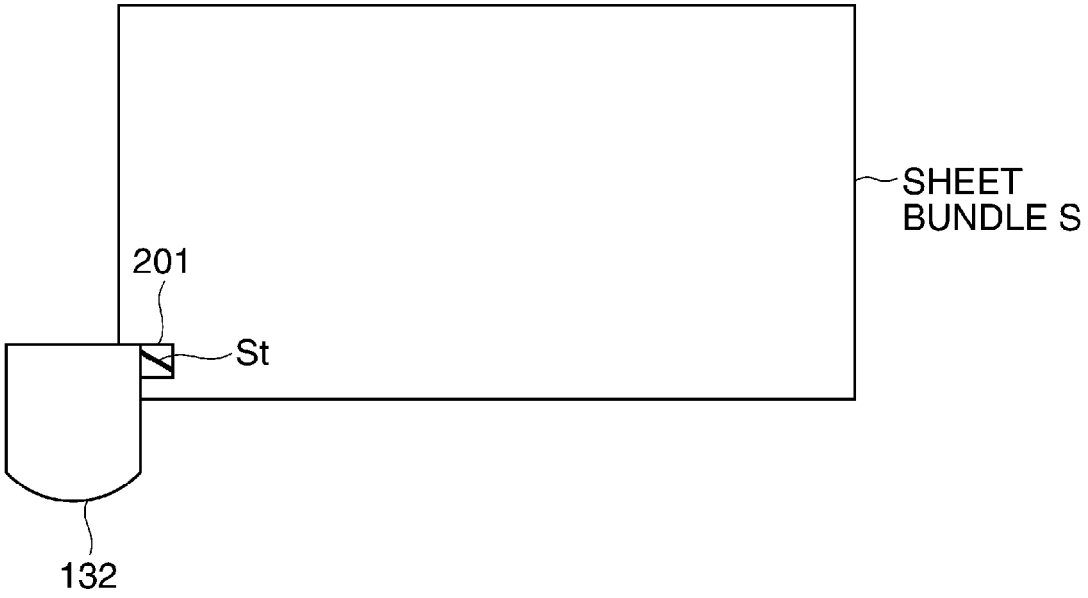

FIG. 12 is a flowchart of a stapling control process in a one-point stapling mode executed by the sheet processing apparatus 100, and FIGS. 13A and 13B are views showing the positional relationship between the stapler 132 and a sheet bundle S in the one-point stapling mode. Note that control of various operations carried out following the flowchart in FIG. 12 is achieved by the CPU 501 by loading a program stored in the ROM 502 into the RAM 503 according to an instruction from the main unit 600.

First, the CPU 501 shifts the stapler 132 to a stapling position as shown in FIG. 13A, turns the stapler 132 so as to perform oblique stapling (step S201), and then causes sheets to be stacked on the processing tray 138 (step S202). When all the sheets have been stacked, the CPU 501 causes the stapler 132 to perform a stapling operation (step S203).

Next, the CPU 501 turns the obliquely positioned stapler 132 to bring the same into a state parallel with the trailing end of a sheet bundle S as shown in FIG. 13B (step S204). Further, as shown in FIG. 13B, the CPU 501 moves the stapler 132 to a staple detection position for detecting a staple St (step S205) and checks whether or not the staple detection sensor 201 has been turned on (step S206).

If the staple detection sensor 201 has been turned on (YES to the step S206), the CPU 501 sets the bit of a staple normal flag to 1 (step S207). Then, the CPU 501 causes the process to proceed to a step S208. On the other hand, if the staple detection sensor 201 remains off (NO to the step S206), the CPU 501 causes the process to proceed to the step S208.

In the step S208, the CPU 501 checks whether or not the staple normal flag is 1. If the staple normal flag is 1 (YES to the step S208), the CPU 501 clears the staple normal flag (step S209), and then causes the sheet bundle S to be discharged onto the lower tray 137 (step S210), followed by terminating the present process. On the other hand, if the staple normal flag is not 1 (NO to the step S208), the CPU 501 sends an error notification to the main unit 600 to cause the main unit 600 to display a message indicative of occurrence of faulty stapling on the display device of the console section 601 (step S211), and then instructs the main unit 600 to stop the print operation (step S212). As a consequence, the print operation in the main unit 600 is stopped. Thereafter, the process proceeds to the step S210, wherein the CPU 501 causes the sheet bundle S to be discharged onto the lower tray 137, followed by terminating the present process.

As described above, according to the present embodiment, the staple detection sensor 201 is attached to the stapler 132, and a staple St is detected by the staple detection sensor 201 by utilizing the shifting of the stapler 132 to a stapling position for performing a stapling operation (binding processing). For this reason, even if the position for driving the staple St has changed (e.g. if the position is not the same as in the two-point stapling mode), it is not necessary to provide a staple detection sensor for each position for driving a staple St. Further, it is not required to additionally provide a dedicated shift mechanism for shifting the staple detection sensor. Thus, staple detection can be performed by a low-cost mechanism.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

Although in the above-described embodiment, the staple detection sensor 201 is attached to the front-view depth side of the stapler 132, it may be attached to the front-view front side of the stapler 132. Since the staple detection sensor 201 is provided on the trailing side of the stapler 132 in the advancing direction as described above in the embodiment, it is possible to increase processing speed in the whole stapling processing including the detection of a staple St. On the other hand, in a case where the staple detection sensor 201 is provided on the leading side of the stapler 132 in the advancing direction, a staple St driven into a sheet bundle is detected during returning of the stapler 132 to its home position. In this case, processing speed is reduced, but staples St at a plurality of points can be detected by the single staple detection sensor 201. Therefore, it is possible to obtain the same effects as provided by the above-described embodiment.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

This application claims priority from Japanese Patent Application No. 2011-142802 filed Jun. 28, 2011, and Japanese Patent Application No. 2012-132862 filed Jun. 12, 2012, which are hereby incorporated by reference herein in their entirety.

What is claimed is:

1. A sheet processing apparatus comprising:

a stapling unit configured to staple a sheet bundle with a staple;

a shift unit configured to shift said stapling unit along an edge of the sheet bundle;

a detection unit configured to detect the staple driven into the sheet bundle by said stapling unit, said detection unit being provided on said stapling unit and being shifted together with said stapling unit by said shift unit; and a controller configured to cause said stapling unit to sequentially perform stapling at a first position and a second position along the edge of the sheet bundle, and then control said stapling unit and said shift unit such that said stapling unit is shifted to a standby position, wherein during a time period from completion of the stapling at the first position to completion of the shifting of said stapling unit to the standby position, said detection unit detects presence or absence of a staple at each of the first position and the second position in accordance with the shifting of said stapling unit.

2. The sheet processing apparatus according to claim 1, wherein said detection unit is provided on a trailing side of said stapling unit in an advancing direction in which said stapling unit is shifted from the first position to the second position.

3. The sheet processing apparatus according to claim 2, wherein said detection unit detects each of a staple at the first position and a staple at the second position during the shifting of said stapling unit in the advancing direction.

4. The sheet processing apparatus according to claim 1, wherein said detection unit detects each of a staple at the first position and a staple at the second position during the shifting of said stapling unit in a direction opposite to the advancing direction.

5. The sheet processing apparatus according to claim 1, further comprising a signal output unit configured to be operable when said detection unit does not detect the staples during the shifting of said stapling unit by said shift unit, to output a signal indicating that an operation of the stapling has not been normally performed by said stapling unit.

6. An image forming apparatus comprising:

an image forming unit configured to form an image on a sheet;

a stapling unit configured to perform stapling processing using a staple on a sheet bundle formed by bundling a plurality of sheets each having an image formed thereon by said image forming unit;

a shift unit configured to shift said stapling unit along an edge of the sheet bundle; a detection unit configured to detect the staple driven into the sheet bundle by said stapling unit, said detection unit being provided on said stapling unit and being shifted together with said stapling unit by said shift unit; and a controller configured to cause said stapling unit to sequentially perform stapling at a first position and a second position along the edge of the sheet bundle, and then control said stapling unit and said shift unit such that said stapling unit is shifted to a standby position, wherein during a time period from completion of the stapling at the first position to completion of the shifting of said stapling unit to the standby position, said detection unit detects presence or absence of a staple at each of the first position and the second position in accordance with the shifting of said stapling unit.

7. The image forming apparatus according to claim 6, further comprising a display unit configured to be operable when said detection unit does not detect the staples during the shifting of said stapling unit, to display a message indicating that a stapling operation has not been normally performed by said stapling unit.

8. The image forming apparatus according to claim 6, further comprising a stoppage control unit configured to be operable when said detection unit does not detect the staples during the shifting of said stapling unit, to stop an image forming operation by said image forming unit.

* * * * *